United States Patent [19]

Gustaveson et al.

[11] Patent Number: 4,829,725

[45] Date of Patent: May 16, 1989

[54] BEHIND-THE-CEILING MOUNTING FOR TELEVISION RECEIVER

[76] Inventors: Keith I. Gustaveson; Elsie E. Gustaveson, both of 3193 Deer Creek Cir., Salt Lake City, Utah 84121

[21] Appl. No.: 112,995

[22] Filed: Oct. 26, 1987

[51] Int. Cl.[4] ..... E04B 5/52; A47B 81/06

[52] U.S. Cl. ..... 52/39; 312/7.2; 52/64; 52/173 R

[58] Field of Search ..... 52/39, 64, 173 R, 27; 312/7.2; 248/185, 317

[56] References Cited

U.S. PATENT DOCUMENTS

| | | | |
|---|---|---|---|
| 3,100,915 | 8/1963 | Pennington | 52/64 |
| 4,395,785 | 8/1983 | Phil-Yoo-Huh | 5/432 |
| 4,412,601 | 11/1983 | Cooper | 312/247 |
| 4,594,817 | 6/1986 | McLaren | 52/36 |
| 4,625,470 | 12/1986 | Heritage | 52/39 |

*Primary Examiner*—John E. Murtagh
*Attorney, Agent, or Firm*—Philip A. Mallinckrodt; Robert R. Mallinckrodt

[57] ABSTRACT

Provision for mounting a television receiving set behind the ceiling of a room, such as a bedroom, for viewing by a person reclining or sitting with head back is made on a support positioned or adapted to be positioned behind a viewing opening in the ceiling of the room and sloping upwardly from such opening. The viewing opening is normally closed by a ceiling panel hinged along one of its ends to the ceiling structure, but can be opened for viewing television by remote-controlled mechanism operative to raise and lower the ceiling panel on its hinge axis. The mechanism is arranged to pull a flexible draw line to raise the ceiling and to slacken such line so the panel can return to closed position by the force of gravity.

11 Claims, 2 Drawing Sheets

BEHIND-THE-CEILING MOUNTING FOR TELEVISION RECEIVER

BACKGROUND OF THE INVENTION

1. Field

The invention is in the field of structure for mounting a television receiving set.

2. State of the Art

It has long been customary to mount television receiving sets immediately below the ceilings of rooms, such as in a hospital, for viewing by a person lying in bed. Various mounting brackets attached to room walls or ceilings have been employed for the purpose.

3. Objects of this Invention

Principal objects in the making of the present invention were to provide behind-the-ceiling mounting structure for a television receiving set which would support and house such a set in proper position for viewing by someone lying in bed or reclining on a couch, sofa, or other support, or even sitting back in a chair, which would be hidden during non-use, and which would be equipped with simple and effective mechanism for opening and closing a ceiling panel by remote control of a person desiring to view a television program.

BRIEF SUMMARY OF THE INVENTION

In accordance with the invention, the television receiving set is mounted on an upwardly and backwardly sloping support immediately behind a viewing opening in the ceiling, and such viewing opening is normally closed and rendered unobvious by a ceiling panel that harmonizes with the ceiling decor, plain or decorative as it may be. Such ceiling panel is hinged along its forward end, and remote controlled, mechanism is provided, preferably above the viewing space and over the viewing opening, with connection to the ceiling panel by a flexible line for raising and lowering such ceiling panel on its hinge axis.

It is preferred to provide mounting structure in the form of a box type housing rising from and sloping upwardly and backwardly from a relatively broad bottom opening. Such mounting structure provides an upwardly and backwardly sloping bottom wall upon which the television receiving set is securely mounted and an upwardly and backwardly sloping top wall, which, together with side walls, protectively enclose the television receiving set.

The mounting structure may be made of wood, such as ordinary dimension lumber, plywood, or particle board obtainable commercially, or of other material, such as fiber glass, plastic, metal, or composites.

The mechanism for opening and closing the panel comprises a reversible electric motor constructed to be turned on by remote control, together with limit switches for turning it off. A flexible line, having one end attached to the hinged ceiling panel, for raising and lowering it on its hinge axis, has its other end attached to a part of the mechanism operated by the motor. In one embodiment of the mechanism, such part is a traveler arranged to reciprocate rectilinearly. The traveler is preferably secured to one length of a chain looped about drive and idler sprockets at opposite ends, respectively, of the path of travel of the traveler, the drive sprocket being located at and in driven connection with the motor. In another embodiment, such part is a pulley in driven connection with the motor for winding and unwinding the flexible line in windless fashion.

THE DRAWINGS

The best modes presently contemplated for carrying out the invention are illustrated in the accompanying drawings in which:

FIG. 1 is a view in perspective of a portion of the ceiling of a room in which the apparatus of the invention is installed, with the ceiling closure panel raised into open position for television viewing from a reclining position in the room;

FIG. 2, a corresponding view, with the ceiling closure panel lowered into closed position;

FIG. 3, a fragmentary perspective view of the television-receiver-mounting structure of FIG. 1 taken from the standpoint of FIG. 2 in the attic above the ceiling of the room, the view being drawn to a considerably larger scale than the preceding figures and with an intermediate portion of the top wall of the structure and a portion of the ceiling closure panel broken away to reveal otherwise hidden structure;

FIG. 4, a longitudinal section through the structure of FIG. 3 showing in side elevation one embodiment of mechanism for opening and closing the ceiling closure panel, the view being drawn to an even larger scale than in FIG. 3;

FIG. 5, a transverse section taken on the line 5—5 of FIG. 4, an intermediate section being broken out for convenience of illustration;

FIG. 6, a fragmentary view taken from the standpoint of the line 6—6 of FIG. 1 to show the mechanism of FIG. 4 in top plan; and FIG. 7, a view corresponding to that of FIG. 4 but showing an alternate form of the mechanism.

DETAILED DESCRIPTION OF THE ILLUSTRATED EMBODIMENTS

Figure 1:
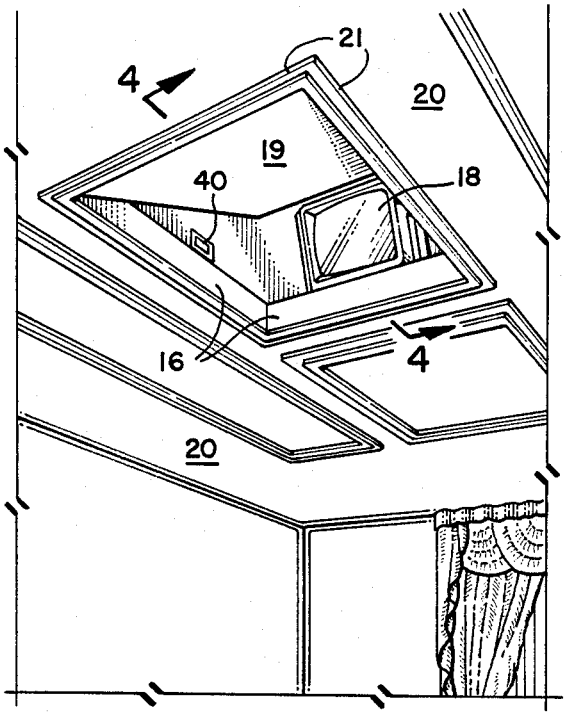
Figure 2:
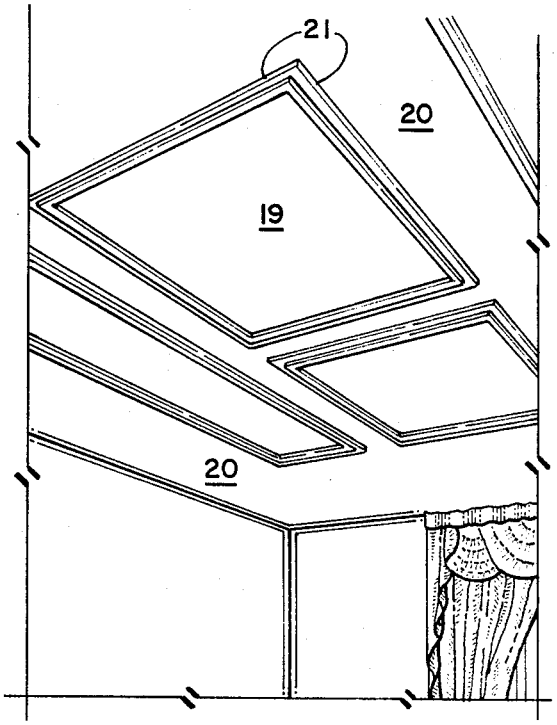
Figure 3:
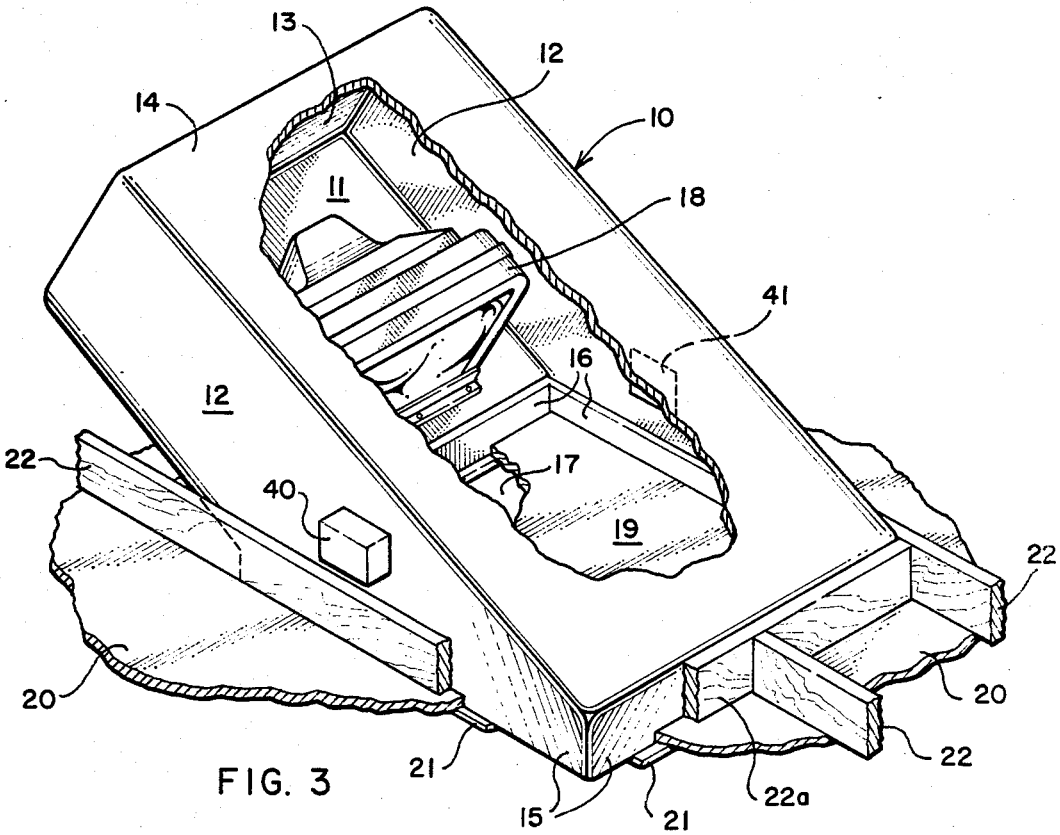

In the form illustrated, a box-type housing 10, FIG. 3, shown as fabricated integrally from suitable material, such as resin-impregnated fiberglass, has an upwardly sloping bottom wall 11, mutually opposite side walls 12, respectively, a rear wall 13, and a top wall 14 rising and sloping backwardly from a frame portion 15 that fits about a structural frame 16. Such frame 16 defines a bottom opening 17 through which a usual type of television receiving set 18 resting on and strapped to bottom wall 11, as by strap **18*a*, is viewed when a ceiling panel 19 is raised from its normal ceiling position, shown in FIGS. 2–4, closing viewing opening 17. In this illustrated instance, the room ceiling 20 is paneled ornamentally, with molding strips 21 defining individual panels and with housing 10 and frame 16 fitting between and fastened to usual rafters 22 in an opening between two of the rafters which is provided by cutting out a portion of an intervening rafter and applying headers 22*a*** at opposite ends of the opening.

Ceiling panel 19 is hinged along its forward end, considering the television set to be mounted rearwardly in the housing. As shown, the hinge 23 is preferably of elongate piano type and is mounted internally of frame 16. A heat vent 24 may be provided in upper wall 14 of housing 10.

Figures 4, 5, 6, 7:
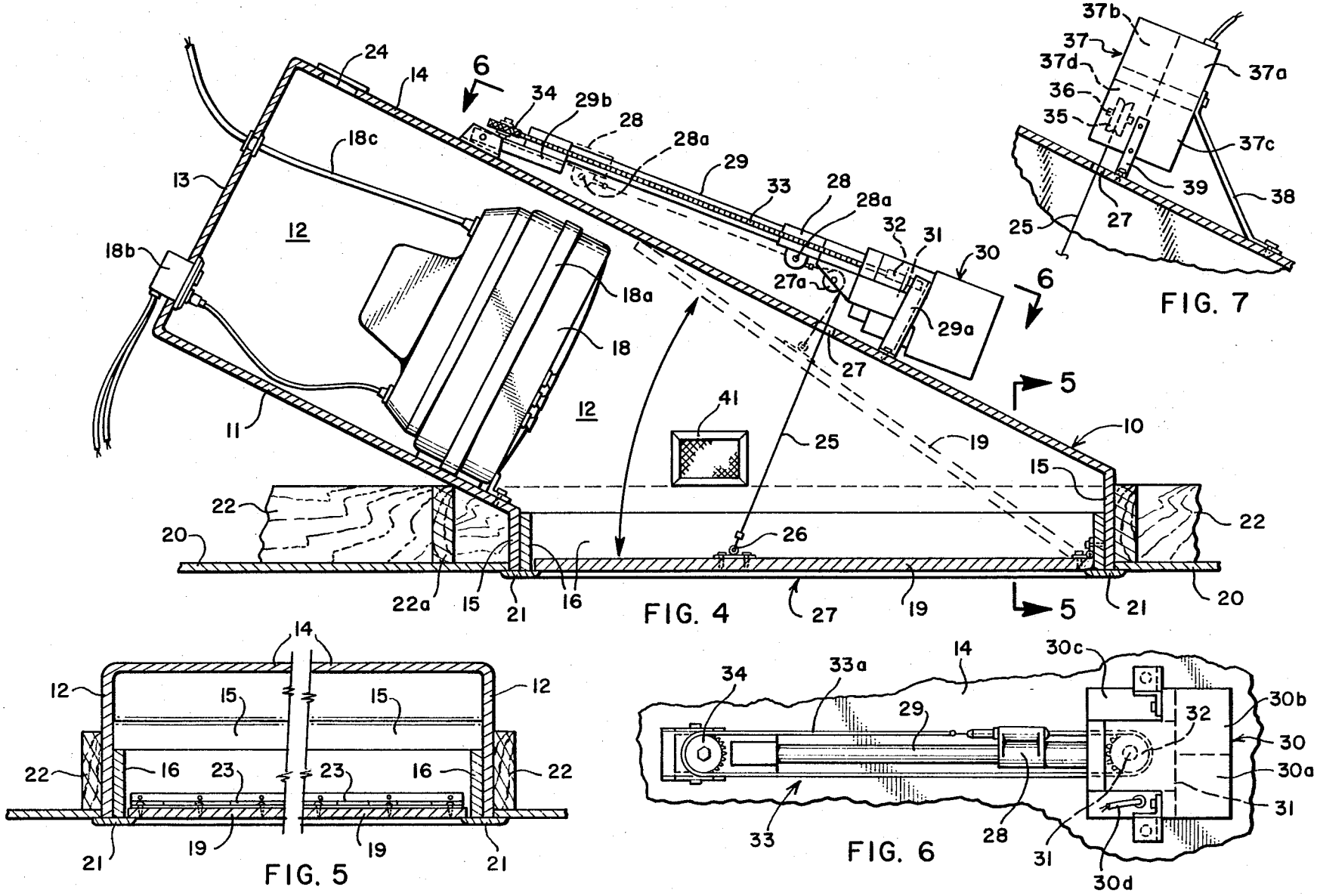

For raising and lowering ceiling panel 19 on its hinge axis, a flexible line, usually a cable 25, FIG. 4, has one end fastened to the inner surface of such panel, as by an eye fitting 26, and is passed through an opening 27 in top wall 14 of housing 10 and over an idler pulley **27*a* to connection of its opposite end with remote-controlled lifting and lowering mechanism, which is preferably mounted on such top wall 14**, exteriorly of such housing.

In the embodiment of panel lifting and lowering mechanism shown in FIGS. 4 and 6, such opposite end of cable 25 is attached to a depending member 28*a* of a reciprocating traveler element 28, which element 28 is slidably mounted as a sleeve on an elongate cylindrical track 29. A commercial drive unit 30 (shown schematically) containing a reversible, electric motor 30*a*, FIG. 6, with remote-control equipment 30*b*, speed reducing gears 30*c*, and limit switches 30*d* for interrupting the supply of electricity to the motor at opposite ends of the reciprocative strokes, has a drive shaft 31 on which is fixedly mounted a sprocket wheel 32 for rotation therewith. A sprocket chain 33 encompasses both sprocket wheel 32 and an idler sprocket wheel 34 and has traveler element 28 fixedly attached to one of its runs 33*a* for back and forth reciprocation between the sprocket wheels as motor 30*a* drives shaft 31 forwardly and in reverse, respectively. One end of track 29 is supported by drive unit 30 (fastened to the upper surface of top wall 14 by means of bracket supports 29*a*) and the other end by a mounting bracket 29*b* pivotally attached to the upper surface of top wall 14. A person wishing to look at television need merely push the button of a standard remote control unit (not shown) to raise panel 19 from closed to open position or to lower such panel back to its closed position.

Alternative mechanism for the purpose is shown in FIG. 7, wherein a cable wind-up pulley 35 is mounted for rotation on the outwardly projecting drive shaft 36 of a drive unit 37 corresponding to drive unit 30 and similarly having a motor 37*a*, remote control equipment 37*b*, speed reducing gears 37*c*, and limit switches 37*d*. Drive unit 37 is mounted by brackets 38 and 39 on the upper surface of housing top wall 14 with pulley 35 placed over and in line with cable passage 27 for winding up cable 25 as drive shaft 36 is rotated in one direction and for unwinding such cable as such drive shaft is rotated in the opposite direction.

Both of the drive units 30 and 37 can be obtained commercially from manufacturers of standard garage door openers. The limit switches should be arranged for activation on the basis of a predetermined number of drive shaft rotations, which is standard in many commercially available drive units.

A plug-in power supply 18*b* for television receiver 18 is normally mounted in back wall 13 of housing 10, and a TV antenna 18*c* conveniently passes through such back wall.

An optional feature of the invention is to provide housing 10 with one or more loud speakers for television sound auxiliary to the sound system provided by the television receiving set itself. Thus, as shown at 40 and 41, auxiliary speakers may be built into side walls 12 and provided with means (not shown) for connection into a television set when that is installed. As so located, the speakers are between viewing opening 17 and ceiling panel 19 in the raised position of the latter.

Whereas this invention is here illustrated and described with specific reference to embodiments thereof presently contemplated as the best modes of carrying out such invention in actual practice, it is to be understood that various changes may be made in adapting the invention to different embodiments without departing from the broader inventive concepts disclosed herein and comprehended by the claims that follow.

We claim:

1. A behind-the-ceiling mounting for a television receiver, comprising a support for a television receiver, said support being mounted in the ceiling structure of a room and sloping backwardly and upwardly from a margin of a viewing opening provided through the ceiling of the room; a ceiling panel hinged along a margin of the viewing opening that is opposite the first-named margin for being raised from a position closing said opening to an open, television-viewing position and for being lowered from said open position back to the position closing the viewing opening; mechanism for raising and lowering said ceiling panel; and a flexible line having one end connected to said mechanism and the other end connected to said panel, said mechanism comprising a remote controlled, reversible motor, and means driven by the motor for alternately pulling and slackening said flexible line so as to raise said panel to its open position and so as to permit it to fall back to its position closing the viewing opening, respectively, said mechanism being provided with limit switches controlling supply of power to said motor so as to stop operation of the motor at the termination of the opening and closing movement, respectively, of said means driven by the motor.

2. A mounting for a television receiver in accordance with claim 1, wherein the mechanism has a rectilinear guide track; a traveler on said track to which the other end of the flexible line is attached; sprocket wheels at opposite ends of said guide track, one of which wheels is in drive relationship with the motor; and a sprocket chain looped about said sprocket wheels.

3. A mounting for a television receiver in accordance with claim 1, wherein the mechanism has a pulley in drive relationship with the electric motor, and to which the other end of the flexible line is attached, for winding up and unwinding said flexible line.

4. A mounting for a television receiver in accordance with claim 1, wherein the support is the bottom panel of a protective, box-like housing for the television receiver; and wherein said housing comprises an open base corresponding to the viewing opening and from which said bottom panel slopes, and additional walls sloping backwardly and upwardly from said base and the viewing opening and arranged to fully enclose the television receiver.

5. A mounting for a television receiver in accordance with claim 4, wherein one of the additional walls is a flat top wall; wherein the mechanism rests upon and is secured to said top wall; and wherein there is a passage through said top wall through which the flexible line extends.

6. A mounting for a television receiver in accordance with claim 4, wherein the ceiling structure is cut to accommodate the viewing opening; and wherein the housing is fitted into and secured to said ceiling structure at said viewing opening.

7. A behind-the-ceiling television receiver mounting for installation in ceiling structure, comprising a housing having an open base adapted to fit into a receiving opening provided in ceiling structure above a corresponding opening in the ceiling of a room, a bottom wall sloping upwardly and backwardly from a margin of said base for receiving and supporting a television receiver, and additional walls sloping backwardly and upwardly from said open base and arranged to fully enclose a television receiver on said bottom wall; mechanism for raising and lowering a ceiling panel fitted into said viewing opening of the ceiling and hinged along its margin that is opposite said margin of the base; and a flexible line having one end connected to said mechanism and the other end connected to said ceiling panel, said mechanism comprising a remote controlled, reversible motor, and means driven by the motor for alternately pulling and slackening said flexible line so as to raise said panel to its open position and so as to permit it to fall back to its position closing the viewing opening, respectively, said mechanism being provided with limit switches controlling supply of power to said motor so as to stop operation of the motor at the termination of the opening and closing movement, respectively, of said means driven by the motor.

8. A television receiver mounting in accordance with claim 7, wherein the mechanism has a rectilinear guide track; a traveler on said track to which the other end of the flexible line is attached; sprocket wheels at opposite ends of said guide track, one of which wheels is in drive relationship with the motor; and a sprocket chain looped about said sprocket wheels.

9. A television receiver mounting in accordance with claim 7, wherein the mechanism has a pulley in drive relationship with the electric motor, and to which the other end of the flexible line is attached, for winding up and unwinding said flexible line.

10. A television receiver mounting in accordance with claim 7, wherein one of the additional walls is a flat top wall; wherein the mechanism rests upon and is secured to said top wall; and wherein there is a passage through said top wall through which the flexible line extends.

11. A television receiver mounting in accordance with claim 7, wherein one or more auxiliary loud speakers for connection to a television set installed on the bottom wall of the housing is built into one or more of the additional walls of the housing and so located as to be between the viewing opening and the ceiling panel in the raised position of the latter.

* * * * *